United States Patent [19]

Sakai et al.

[11] 3,994,130

[45] Nov. 30, 1976

[54] EXHAUST MANIFOLD ASSEMBLY WITH CATALYTIC CONVERTER

[75] Inventors: Yasuyuki Sakai; Hideaki Matsui, both of Susono, Japan

[73] Assignee: Toyota Jidosha Kogyo Kabushiki Kaisha, Japan

[22] Filed: May 1, 1975

[21] Appl. No.: 573,424

[30] Foreign Application Priority Data

Feb. 10, 1975 Japan ..... 50-17864[U]

[52] U.S. Cl. ..... 60/302; 23/288 F

[51] Int. Cl.[2] ..... F01N 3/15

[58] Field of Search ..... 60/302, 299, 282; 23/288 FR

[56] References Cited

UNITED STATES PATENTS

| | | | |
|---|---|---|---|
| 1,793,813 | 2/1931 | MacKinnon | 60/302 |
| 3,788,070 | 1/1974 | Camarasa | 60/282 |

FOREIGN PATENTS OR APPLICATIONS

| | | | |
|---|---|---|---|
| 62,204 | 8/1970 | Germany | 60/302 |
| 1,043,890 | 9/1966 | United Kingdom | 60/302 |

*Primary Examiner*—Douglas Hart

*Attorney, Agent, or Firm*—Toren, McGeady and Stanger

[57] ABSTRACT

A generally cylindrically shaped annular catalytic converter is provided within the manifold of an exhaust gas system with branch pipes extending from the manifold to introduce exhaust gases thereinto. Each of the branch pipes defines a flow direction extending tangentially of the catalytic converter with the central axis of each branch pipe being directed at an oblique angle relative to the central axis of the catalytic converter and spaced from each other axially relative to the converter central axis.

7 Claims, 5 Drawing Figures

EXHAUST MANIFOLD ASSEMBLY WITH CATALYTIC CONVERTER

BACKGROUND OF THE INVENTION

The present invention relates generally to an exhaust gas manifold assembly for an internal combustion engine and more particularly to an assembly which includes a plurality of branch pipes each connected to introduce exhaust gas into the manifold of the assembly. Each of the branch pipes is connected between an exhaust port of a cylinder of an internal combustion engine and the exhaust system manifold in order to direct exhaust gas from the cylinder ports into the manifold. The manifold includes a main exhaust pipe through which gases are exhausted from the manifold. The catalytic converter which is utilized is of the type comprising a cylindrical configuration having an annular cross section.

In manifold assemblies of the type to which the present invention relates, exhaust gas released from the exhaust ports of respective cylinders of the engine pass through the respective branch pipes to a junction with a main exhaust pipe from which the exhaust gas is further passed through a hollow cylindrical catalytic converter disposed within the exhaust system. The gases flow radially through the converter into its hollow inner core and then flow axially thereof through the main exhaust port.

In such pipes of exhaust systems, it is highly desirable to increase the exhaust gas cleansing efficiency of the catalyst and to improve durability of the converter receptacle. Furthermore, it is beneficial if the exhaust gas distribution within the catalytic converter be maintained as uniform as possible.

The present invention is aimed toward improving the performance of such exhaust manifold assembly systems having the catalytic converter incorporated therein. The effects of the present invention are produced by appropriately arranging each of the branch pipes entering the manifold in a particular orientation taken relative to the structure and configuration of the catalytic converter contained within the manifold.

SUMMARY OF THE INVENTION

Briefly, the present invention may be described as an exhaust manifold assembly for an internal combustion engine having a plurality of cylinders each with exhaust ports and incorporating therein a catalytic converter. The assembly comprises a manifold, a catalytic converter enclosed within the manifold and a plurality of branch pipes each connected between one of the engine exhaust ports and the manifold to deliver engine exhaust gases into the manifold. The catalytic converter is formed with a generally cylindrical longitudinal configuration and an annular cross-sectional configuration with the body of the converter having a generally central longitudinal axis extending therethrough. Each of the branch pipes has a generally tubular configuration defining a central axis extending longitudinally thereof. By a principal feature of the invention, each of the branch pipes is connected to the manifold with the central axis of each of the branch pipes located to extend tangentially relative to the catalytic converter and with each of said branch pipe central axes arranged in nonintersecting oblique directions extending at different angles relative to the central longitudinal axis of the catalytic converter.

By a further aspect of the invention the points at which the branch pipes are connected to the manifold are spaced axially from each other taken relative to the longitudinal axis of the catalytic converter.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there is illustrated and described a preferred embodiment of the invention.

DETAILED DESCRIPTION OF THE PREFERRED EMBODIMENT

Figure 1:
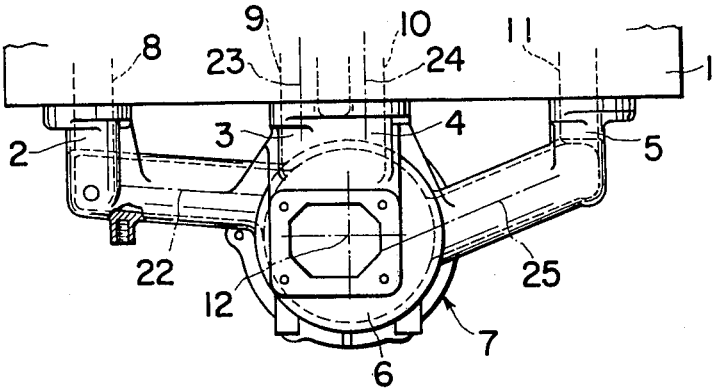
FIG. 1 is a plan view of an exhaust manifold assembly according to the present invention.
Figure 2:
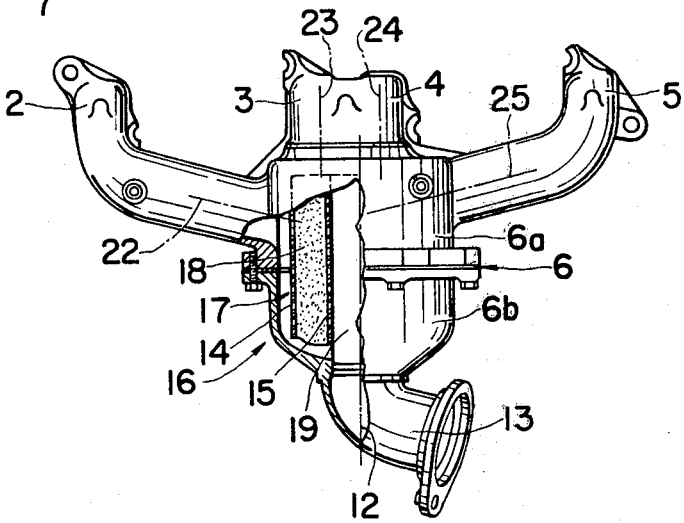
FIG. 2 is a side view of the assembly of FIG. 1.

Referring now to the drawing, the present invention is depicted by way of an embodiment adapted for use with a 4-cylinder internal combustion engine. A cylinder block 1 of the engine comprises four exhaust ports from which exhaust gas flows from the individual cylinders of the engine with each of the exhaust ports having attached thereto one of four branch pipes 2, 3, 4 and 5. The branch pipes are connected into a manifold 6 having a main exhaust pipe 13 extending therefrom. The branch pipes 2, 3, 4 and 5, the manifold 6 and the main pipe 13 comprise an overall manifold assembly 7 disposed on one side of the cylinder block 1 of the internal combustion engine. Each of the branch pipes 2, 3, 4 and 5 is joined by a flange to the exhaust ports 8, 9, 10 and 11 which lead into the respective cylinders of the engine. The opposite ends of the branch pipes are formed integrally with an upper portion **6*a* of the manifold 6. The manifold 6 comprises a generally cylindrical configuration having a central axis 12 which extends substantially parallel to the planar side face of the cylinder block 1.**

A lower half portion **6*b* of the manifold 6 is joined by flanges with the upper half portion 6*a* and the exhaust pipe 13 is connected at the bottom of the lower half portion 6*b*.**

Within the manifold 6, and coaxially fitted therein, there is provided a hollow cylindrical catalytic converter 16 having a hollow cylindrical receptacle 17. The converter 16 comprises a porous outer cylindrical wall 14 and a concentric porous inner cylindrical wall 15. The walls 14 and 15 define therebetween a cylindrical annular space which is packed with catalyst grains in a known manner. Furthermore, the porous cylindrical walls 14 and 15 define the annular body of the converter 16 with a pair of annular end faces which have walls closing the end faces to prevent gas flow therethrough.

The inner cylindrical wall 15 of the catalytic converter 16 is arranged in direct flow communication with the exhaust pipe 13 and is preferably formed with an inner diameter which is equivalent to the inner diameter of the exhaust pipe 13.

Exhaust gas flowing from the exhaust ports 8, 9, 10 and 11 of the engine pass through the branch pipes 2, 3, 4 and 5 of the manifold assembly 7 into the manifold 6 and then enter the catalytic converter 16 through holes in the outer cylinder 14 thereof. The harmful components of the exhaust gases are either oxidized or reduced by the catalyst grains 18 contained within the converter thereby to cleanse the engine exhaust gases. The cleansed gas passes through holes in the inner cylinder 15 and into a central space 19 of the converter 16 from which the gas flows into the exhaust pipe 13.

Figure 3:
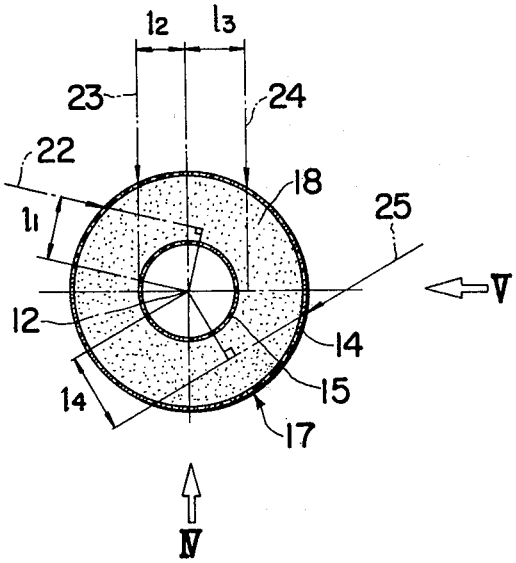
FIG. 3 is a schematic plan view showing the exhaust gas flow patterns through the catalytic converter of the assembly of the invention.

In accordance with the present invention, as is best seen in the plan view of FIG. 3, the respective branch pipes 2, 3, 4 and 5 comprise, respectively, central axes 22, 23, 24 and 25. Each of the axes 22, 23, 24 and 25 are arranged eccentrically relative to the central axis 12 of the manifold 6, which is also the central longitudinal axis of the catalytic converter 16. Accordingly, each of the axes 22, 23, 24 and 25 is directed tangentially relative to the annular cross-sectional configuration of the converter 16 with each of the branch pipe axes being spaced from or nonintersecting with the central axis 12.

As shown in FIG. 3, each of the axes 22, 23, 24 and 25 is spaced from the central axis 12 by distances $l_1$, $l_2$, $l_3$ and $l_4$, respectively.

In the preferred embodiment of the present invention, the axes of the branch pipes are arranged such that $l_2 < l_3 < l_1, < l_4$. However, this relationship may be suitably changed as desired.

Figure 4:
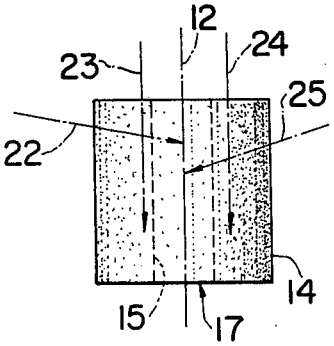
FIGS. 4 and 5 are views taken in the directions of the arrows IV and V in FIG. 3, respectively.
Figure 5:
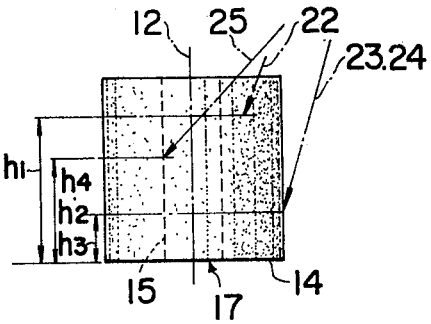

Furthermore, as will be apparent from FIGS. 4 and 5, the axes 22–25 are arranged to extend at different angles relative to the center axis 12. Thus, it will be seen that each of the axes 22–25, extends obliquely to the axis 12 while being spaced therefrom so as not to intersect the axis 12.

Additionally, the axes 22–25 are arranged to be spaced apart relative to each other in directions taken axially of the central axis 12. As best seen in FIGS. 4 and 5, each of the axes 22–25 is arranged at a different level relative to the axis 12, with these levels being identified as $h_1$, $h_2$, $h_3$, and $h_4$. In the preferred embodiment of the present invention, the arrangement is such that $h_2 = h_4$. Thus, as will be seen from FIGS. 4 and 5 the exhaust gases are directed toward the catalytic converter 16 at different axially spaced locations thereon.

As a result of the foregoing arrangement, the exhaust gases flowing into the catalytic converter 16 from the respective branch pipes 2–5 enter the receptacle 17 from the holes in the outer cylinder 14 at different vertical levels, as best seen in FIGS. 4 and 5 and the gas is then directed toward the lower end of the central space 19 while swirling in a generally clockwise direction, as viewed in FIG. 3, within the annular space between the outer and inner cylinders 14 and 15.

In this manner, the exhaust gas flows from the respective branch pipes 2–5 into the catalytic converter 16 with a substantially uniform distribution so that the temperature of the converter receptacle 17 and the catalyst grains 18 therein are maintained substantially constant to reduce thermal strain upon the receptacle. Thus, durability of the converter unit is improved while also increasing the cleansing efficiency of the catalyst grains. Furthermore, inasmuch as no local rise of temperature takes place within the catalyst grains, durability of the catalytic material itself is also improved.

While a specific embodiment of the invention has been shown and described in detail to illustrate the application of the inventive principles, it will be understood that the invention may be embodied otherwise without departing from such principles.

What is claimed is:

1. An exhaust manifold assembly for an internal combustion engine having a plurality of cylinders each with exhaust ports and incorporating therein a catalytic converter system comprising:

a manifold;

a catalytic converter enclosed within said manifold, said catalytic converter having a generally cylindrical longitudinal configuration with an annular cross-sectional configuration and defining a generally central axis extending longitudinally thereof;

a plurality of exhaust branch pipes each connected between one of said engine exhaust ports and said manifold to deliver engine exhaust gases into said manifold, said branch pipes each having a generally tubular configuration defining a central longitudinal axis thereof;

said branch pipes being connected to said manifold with the central axis of each of said branch pipes located to extend tangentially relative to said catalytic converter and with each of said central axes arranged in nonintersecting oblique directions extending at different angles relative to said central longitudinal axis of said catalytic converter.

2. An assembly according to claim 1 wherein said branch pipes are each connected to said manifold at axially spaced apart locations taken relative to the longitudinal axis of said catalytic converter.

3. An assembly according to claim 1:

wherein said internal combustion engine comprises a generally planar side face through which each of said exhaust ports open;

wherein said manifold is formed with a generally cylindrical configuration having a centrally located longitudinal axis; and wherein said manifold is mounted with its longitudinal axis extending generally parallel to the plane of said engine side face.

4. An assembly according to claim 1 wherein said catalytic converter is formed with an outer porous cylindrical wall and an inner porous cylindrical wall defining therebetween said annular cross-sectional configuration of said catalytic converter with a pair of annular axial end faces and wherein said axial end faces of said catalytic converter are closed.

5. An assembly according to claim 3 including a main outlet pipe connected to said manifold for exhausting gas therefrom, said main outlet pipe having a diameter equivalent to the diameter of said inner porous cylindrical wall of said catalytic converter and being connected in flow communication therewith.

6. An assembly according to claim 1 wherein said branch pipes comprise a plurality of outer branch pipes and a plurality of inner branch pipes, said outer branch pipes being connected to said manifold with their axes spaced further away from said catalytic converter longitudinal axis than the axes of said inner branch pipes.

7. An assembly according to claim 4, wherein said manifold is composed of an upper portion and a lower portion each joined together by flange means.

* * * * *